US010082748B2

(12) United States Patent
Kitamura et al.

(10) Patent No.: US 10,082,748 B2
(45) Date of Patent: Sep. 25, 2018

(54) IMAGE FORMING APPARATUS USING DETECTION FEEDBACK TO CONTROL BELT MOVEMENT

(71) Applicant: Oki Data Corporation, Tokyo (JP)

(72) Inventors: Makoto Kitamura, Tokyo (JP); Satoshi Gima, Tokyo (JP)

(73) Assignee: Oki Data Corporation, Tokyo (JP)

( * ) Notice: Subject to any disclaimer, the term of this patent is extended or adjusted under 35 U.S.C. 154(b) by 0 days.

(21) Appl. No.: 15/411,245

(22) Filed: Jan. 20, 2017

(65) Prior Publication Data

US 2017/0248872 A1 Aug. 31, 2017

(30) Foreign Application Priority Data

Feb. 26, 2016 (JP) ..... 2016-035318

(51) Int. Cl.
*G03G 15/00* (2006.01)
*G03G 15/16* (2006.01)

(52) U.S. Cl.
CPC ..... *G03G 15/161* (2013.01)

(58) Field of Classification Search
CPC ..... G03G 15/161
USPC ..... 399/71
See application file for complete search history.

(56) References Cited

U.S. PATENT DOCUMENTS 4,235,548 A * 11/1980 Miyamoto ..... G03G 15/18 399/385
2003/0170039 A1* 9/2003 Taguchi ..... G03G 15/1605 399/66
2013/0016996 A1* 1/2013 Yuasa ..... G03G 15/0189 399/121
2015/0010318 A1* 1/2015 Cannon ..... G03G 15/161 399/71

FOREIGN PATENT DOCUMENTS

JP 2015-168216 A 9/2015

* cited by examiner

*Primary Examiner* — Quana M Grainger
(74) *Attorney, Agent, or Firm* — Panitch Schwarze Belisario & Nadel LLP

(57) ABSTRACT

An image forming apparatus includes a movable endless belt, an image forming unit forming a developer image, a transfer unit transferring the developer image to a medium on a downstream side of the image forming unit in a belt moving direction, a belt cleaning unit cleaning the belt on a downstream side of the transfer unit in the belt moving direction, a detection unit detecting a surface state of the belt on a downstream side of the transfer unit and on an upstream side of the belt cleaning unit in the belt moving direction, and a control unit stopping move of the belt based on a result detected at the detection unit before any foreign object on the belt reaches the belt cleaning unit or the image forming unit.

15 Claims, 19 Drawing Sheets

IMAGE FORMING APPARATUS USING DETECTION FEEDBACK TO CONTROL BELT MOVEMENT

CROSS REFERENCE TO RELATED APPLICATION

This application claims priority benefits under 35 USC, section 119 on the basis of Japanese Patent Application No. 2016-035318, the disclosure of which is incorporated herein by reference.

BACKGROUND OF THE INVENTION

1. Field of the Invention

This invention relates to an image forming apparatus and a method for controlling the image forming apparatus and, more particularly, to an image forming apparatus and a method for controlling the image forming apparatus detecting a foreign object attaching to a belt.

2. Description of Related Art

Image forming apparatuses have been known forming images on a label sheet using an intermediate transfer belt. A conventional image forming apparatus transfers toner images in respective colors transferred to a photosensitive drum sequentially to an intermediate transfer belt in an overlapping manner, thereby forming multicolor toner images overlapping the toner images in respective colors on the intermediate transfer belt. The multicolor toner images transferred to the intermediate transfer belt are further transferred onto a label seal by a transfer roller, as disclosed in, e.g., Japanese Patent Application Publication (A1), No. 2015-168216.

Such a prior art image forming apparatus may be suffered from attachment of foreign object such as, e.g., labels to the intermediate transfer belt. Under such a situation, if the foreign object attached to the intermediate transfer belt reaches a cleaning unit or an image forming unit, the cleaning unit or the image forming unit may be damaged or suffered from getting dirty, thereby lowering quality of the images to be formed. Where the quality of the images is graded down, it is required to replace the belt portion including the intermediate transfer belt, or the image forming unit with new one, so that there arises problems such as, e.g., increased inactive times, increased costs, and shortened life time of the parts.

It is therefore an object of the invention to provide an image forming apparatus and a method for controlling the image forming apparatus in which the belt can be stopped before any foreign object on the belt reaches a cleaning unit or an image forming unit.

SUMMARY OF THE INVENTION

According to an aspect of the invention, an image forming apparatus includes: a movable endless belt; an image forming unit forming a developer image; a transfer unit transferring the developer image to a medium on a downstream side of the image forming unit in a moving direction of the belt; a belt cleaning unit cleaning the belt on a downstream side of the transfer unit in the moving direction of the belt; a detection unit detecting a surface state of the belt on a downstream side of the transfer unit in the moving direction of the belt and on an upstream side of the belt cleaning unit in the moving direction of the belt; and a control unit stopping move of the belt based on a result detected at the detection unit.

In another aspect of the invention, a method for controlling an image forming apparatus having: a movable endless belt; an image forming unit forming a developer image; a transfer unit transferring the developer image to a medium on a downstream side of the image forming unit in a moving direction of the belt; and a belt cleaning unit cleaning the belt on a downstream side of the transfer unit in the moving direction of the belt, the method comprising the steps of: detecting a surface state of the belt at a position on a downstream side of the transfer unit in the moving direction of the belt and on an upstream side of the belt cleaning unit in the moving direction of the belt; and stopping move of the belt based on the detected result of the surface state of the belt.

These and other objects, features, aspects and advantages of the disclosed image forming apparatus and its controlling method will become apparent to those skilled in the art from the following detailed description, which, taken in conjunction with the annexed drawings, discloses preferred embodiments.

BRIEF DESCRIPTION OF THE DRAWINGS

Referring now to the attached drawings which form a part of this original disclosure.

DETAILED DESCRIPTION OF EMBODIMENTS

Hereinafter, embodiments according to the invention are described in detail with reference to the drawings.

First Embodiment

Figure 1:
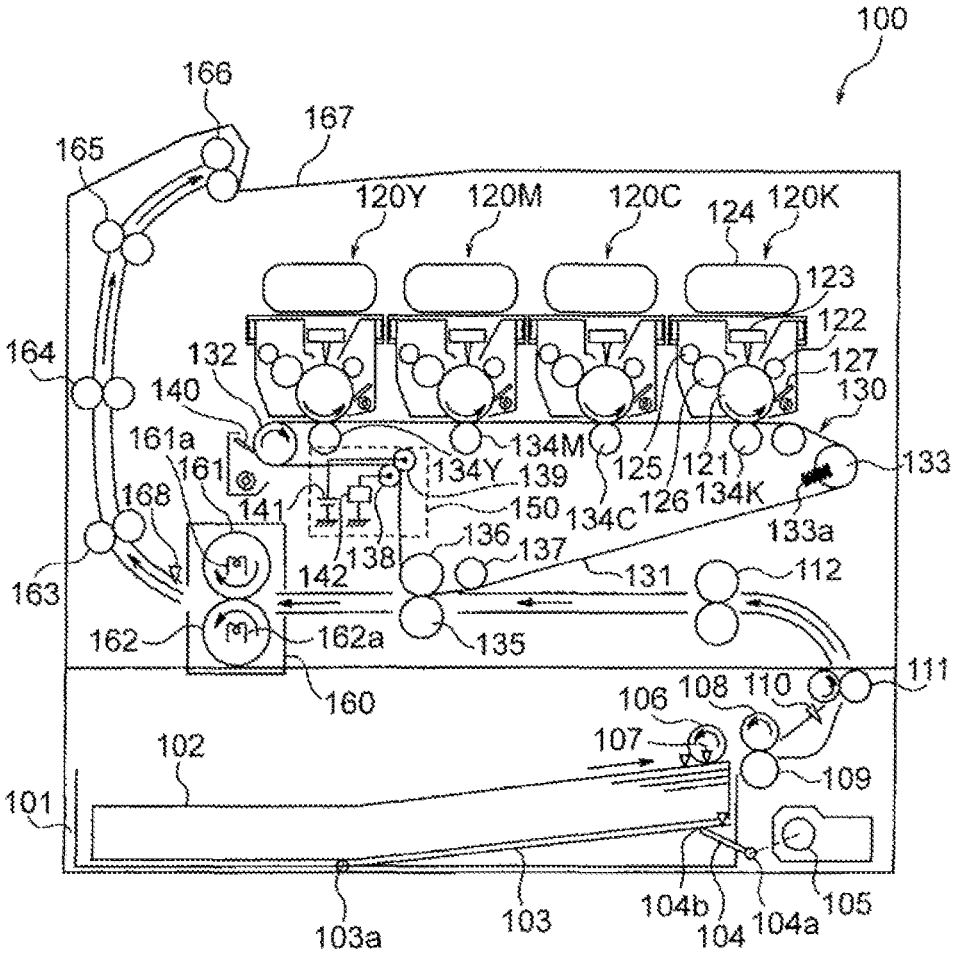
FIG. 1 is a schematic view showing a structure of an image forming apparatus according to a first embodiment of the invention.

FIG. 1 shows a schematic diagram showing a structure of an image forming apparatus 100 according to the first embodiment. A paper tray 101 has an interior accumulating paper 102 as media and is detachably attached to the image forming apparatus 100. A paper mounting plate 103 pivotally supported at a support shaft 103*a* is arranged inside the paper tray 101 to load the paper 102 on the paper mounting plate 103.

A lift-up lever 104 is provided pivotally around a support shaft 104*a* on a side loading the paper 102 of the paper tray 101. The support shaft 104*a* engages a lift-up motor 105 in a separable way. Where the paper tray 101 is attached to the image forming apparatus 100, the lift-up lever 104 engages the lift-up motor 105 to control drive of the lift-up motor 105 by a feed and conveyance controller 183 as described below (see, FIG. 4).

When the lift-up lever 104 rotates, a tip 104*b* of the lift-up lever 104*b* lifts up the paper mounting plate 103, thereby lifting up the paper 102 stacked on the paper mounting plate 103. The paper 102 comes in contact with a pickup roller 106 where lifted up to a certain level, and a moving-up detection unit 107 detects the contact. The feed and conveyance controller 183 stops the lift-up motor 105 based on detected results of the moving-up detection unit 107.

The pickup roller 106 feeds out the paper 102 on the paper tray 101 together with a feed roller 108 and a retard roller 109 disposed as a pair in contact to each other. The pickup roller 106 and the feed roller 108 are driven to rotate in an arrow direction by a feed motor, not shown. The pickup roller 106 and the feed roller 108 incorporate inside an one-way clutch, respectively, so that the rollers can idle in the arrow direction even where the rotational drive is stopped. The pickup roller 106 takes out the paper 102 from the paper tray 101, and the feed roller 108 and the retard roller 109 feed out the paper 102 sheet by sheet sequentially to a conveyance route even where plural sheets of the paper 102 are fed at the same time. Operation of the pickup roller 106, the feed roller 108, and the retard roller 109 is controlled by the feed and conveyance controller 183 described below.

A paper sensor 110, a conveyance roller pair 111 restricting obliquely feeding of the paper 102, a conveyance roller pair 112 feeding the paper 102 to a portion at which the toner images are transferred to the paper 103, are disposed on a downstream side of the feed roller 108 and the retard roller 109 in the conveyance direction of the paper 102. Those conveyance roller pairs 111, 112 receive force via a drive transmission means, not shown, from a conveyance drive motor, not shown, and operation of the pairs is controlled by the feed conveyance controller 183 as described below.

The image forming apparatus 100 has four image forming units 120K, 120Y, 120M, 120C forming toner images in respective colors of black, yellow, magenta, and cyan. In this specification, those image forming units are collectively referred to as image forming units 120 where distinction among the colors is not required. The image forming units 120 are disposed above the belt unit 130. Because the interior structures of the image forming units 120 are in common, the image forming unit 120K for black color is exemplified to explain the interior structure.

The image forming unit 120K is formed with a photosensitive drum 121 serving as an image carrier to form toner images as developer images. The photosensitive drum 121 is rotatable in an arrow direction. The image forming unit 120K includes a charge roller 122, an exposure apparatus 123, a toner container 124, a supply roller 125, a developing roller 126, and a drum cleaning unit 127.

The charge roller 122 supplies electric charges to the surface of the photosensitive drum 121 to charge the surface. The exposure apparatus 123 selectively radiates light the surface of the charged photosensitive drum 121 to form electrostatic latent images. The toner container 124 contains toner as a developer. The supply roller 125 supplies to the developing roller 126 the toner contained in the toner container 124. The developing roller 126 attaches the toner to the surface of the photosensitive drum 121 formed with the electrostatic latent images to form the toner images as the developer images. The drum cleaning unit 127 removes remaining toner after the toner images on the photosensitive drum 121 are transferred. It is to be noted that drums and rollers provided in the image forming unit 120 receive force from a drive source or sources, not shown, via such as gears and rotate. An image forming controller 182 as described below shown in FIG. 4 controls operation of the image forming unit 120.

The belt unit 130 transfers the toner images formed by the image forming unit 120 to an intermediate transfer belt 131, and transfers the toner images to the paper 102 supplied from the paper tray 101. The belt unit 130 includes the intermediate transfer belt 131, a drive roller 132, a tension roller 133, primary transfer rollers 134K, 134C, 134M, 134Y (hereinafter, collectively referred to as primary transfer roller 134 if distinction of colors are not required), a secondary transfer roller 135, a secondary transfer backup roller 136, a guide roller 137, a belt outside roller 138, and a bias roller 139.

Figure 2:
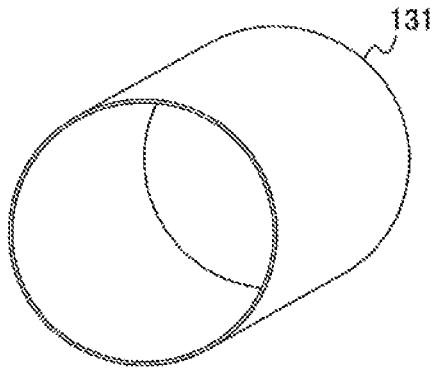
FIG. 2 is a perspective view showing an intermediate transfer belt according to the first embodiment.

The intermediate transfer belt 131 is tensioned by the drive roller 132, the tension roller 131, the primary transfer roller 134, the secondary transfer backup roller 136, the guide roller 137, and the belt outside roller 138, and is a movable belt. The intermediate transfer belt 131 is the endless belt as shown in FIG. 2 and has a conductivity. The outer surface of the intermediate transfer belt 131 is a surface to which the toner images are transferred.

The drive roller 132 is driven by a drive unit not shown. The tension roller 133 applies tension to the intermediate transfer belt 131 by an urging means such as a coil spring 133*a*. The primary transfer roller 134 is arranged as opposing to the photosensitive drum 121, and a prescribed voltage applies to the primary transfer roller 134 to transfer to the intermediate transfer belt 131 the toner images formed on the photosensitive drum 121. A prescribed voltage applies to the secondary transfer roller 135 to transfer the toner images transferred to the intermediate transfer belt 131 further to the paper 102. In other words, the secondary transfer roller 135 functions as a transfer unit for transferring the toner images to the paper 102. The secondary transfer backup roller 136 opposes to the secondary transfer roller 135 and assists the roller when the toner images are transferred to the paper 102.

The guide roller 137 guides a moving direction of the intermediate transfer belt 131. The belt outside roller 138 tensions the intermediate transfer belt 131 from a side of the outer surface of the intermediate transfer belt 131. The bias roller 139 is disposed at a portion opposing the belt outside roller 138 astride the intermediate transfer belt 131. The belt outside roller 138 and the bias roller 139 are closely contacting the intermediate transfer belt 131.

The belt cleaning unit 140 removing remaining toner on the intermediate transfer belt 131 is disposed on a downstream side of the secondary transfer roller 135 in the moving direction of the intermediate transfer belt 131. The belt unit 130 is formed with a direct current power source 141 for applying a prescribed voltage between the bias roller 139 and the belt outside roller 138 to render toner in an excessive amount not remain on the intermediate transfer belt 131. A current amount detection unit 142 is provided to the belt unit 130 for detecting an amount of current flowing between the bias roller 139 and the belt outside roller 138. The bias roller 139 and the belt outside roller 138, the direct current power source 141, and the current amount detection unit 142 function as a detection unit 150 detecting a value for detecting as to whether any foreign object is attached to the intermediate transfer belt 131. It is to be noted that the foreign object is an object not deemed as a target to be cleaned. The foreign object is a thing other than the toner, and for example, may be the paper 102 or a part of the paper 102. The detection unit 150 is disposed on an upstream side of the secondary transfer roller 135 in the moving direction of the intermediate transfer belt 131 and on an upstream side of the belt cleaning unit 140 in in the moving direction of the intermediate transfer belt 131. The detection unit 150 detects the surface state of the intermediate transfer belt 131. Details of the detection unit 151 are described below. It is to be noted that a belt controller 184 (see FIG. 4) controls the operation of the belt unit 130.

A fixing unit 160 is constituted of a roller pair, or namely an upper roller 161 and a lower roller 162, and fixes the toner images to the paper 102 in application of beat and pressure to the toner images transferred to the paper 102. The upper roller 161 includes a halogen lamp 161*a* provided inside serving as a heat source, and the surface of the upper roller 161 is formed of an elastic body. The lower roller 162 includes a halogen lamp 162*a* provided inside serving as a heat source, and the surface of the lower roller 162 is also formed of an elastic body. A fixing controller 185 (see FIG. 5) controls operation of respective portions of the fixing unit 160.

After fixing the toner images, the paper 102 is conveyed with delivery roller pairs 163, 164, 165, 166 and delivered to a stacker unit 167. Drive force is transmitted to the delivery roller pairs 163, 164, 165, 166 form a drive power source, not shown, via a drive transmission means, not shown, and a feed and conveyance controller 184 (see, FIG. 4) described below controls operation of the delivery roller pairs 163, 164, 165, 166. A paper sensor 168 disposed on an output side of the fixing unit 160 detects drive timings of the delivery roller pairs 163, 164, 165, 166.

Figure 3:
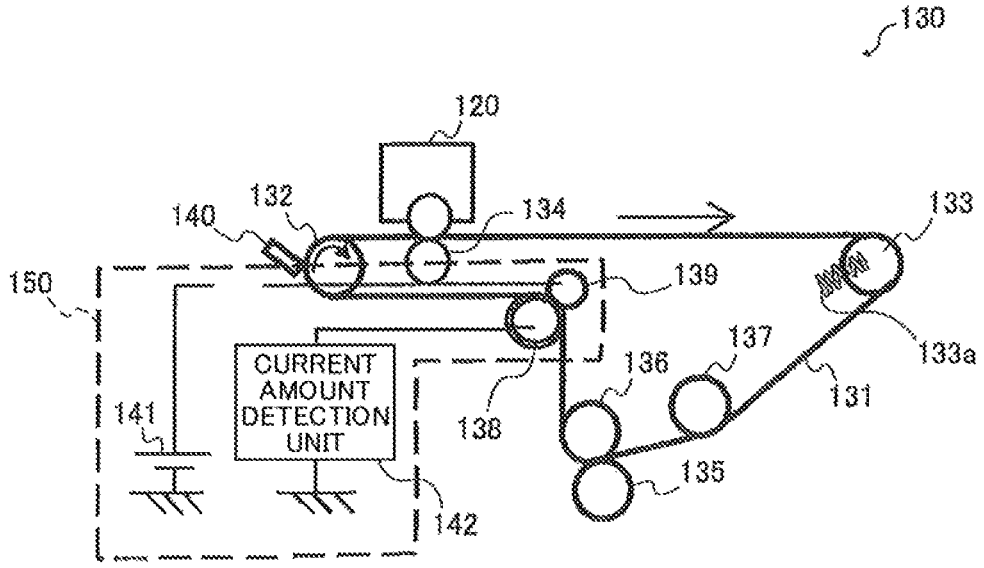
FIG. 3 is an illustration showing a structure of a belt unit and a detection unit according to the first embodiment.

FIG. 3 is a schematic diagram showing a structure of the belt unit 130 and the detection unit 150. The drive roller 132, the tension roller 133, the primary transfer roller 134, the secondary transfer backup roller 136, the guide roller 137, and the bias roller 139 are arranged inside the intermediate transfer belt 131 in the belt unit 130. The belt outside roller 138 is disposed outside the intermediate transfer belt 131 at the belt unit 130.

The detection unit 150 includes the direct current power source 141, the belt outside roller 138, the bias roller 139, and the current amount detection unit 142. The direct current power source 141 is a power source applying a prescribed direct current voltage to the bias roller 139 and the current amount detection unit 142. The bias roller 139 serves as a first terminal flowing a current to the intermediate transfer belt 131 whereas the belt outside roller 138 serves as a second terminal flowing a current to the intermediate transfer belt 131. In FIG. 3, the direct current power source 141 is provided on a side of the bias roller 139 but can be provided on a side of the belt outside roller 138.

The bias roller 139 and the belt outside roller 138 are disposed on the in the moving route of the intermediate transfer belt 131 between the belt cleaning unit 140 and the secondary transfer roller 135. More specifically, the bias roller 139 and the belt outside roller 138 are disposed on a downstream side of the secondary transfer roller 135 in the moving direction of the intermediate transfer belt 131 and on an upstream side of the belt cleaning unit 140 in the moving direction of the intermediate transfer belt 131.

The bias roller 139 and the belt outside roller 138 sandwich the intermediate transfer belt 131, and any one of rollers contacts an outer surface from which any foreign object on the intermediate transfer belt 131 is detected. The surface detecting the foreign object on the intermediate transfer belt 131 is an outer surface of the intermediate transfer belt 131. The bias roller 139 and the belt outside roller 138 are disposed at portions at which the detected foreign object does not reach the belt cleaning unit 140 by stopping the move of the intermediate transfer belt 131, where it is judged or detected as the foreign object is attached to the intermediate transfer belt 131 based on the current value detected at the current amount detection unit 142.

The current amount detection unit 142 detects the current value of the current flowing between the bias roller 139 and the belt outside roller 138. It is to be noted that the current amount detection unit 142 can be positioned at any location as far as the unit can detect the current amount between the bias roller 139 and the belt outside roller 138, and can be placed between the direct current power source 141 and the bias roller 139. The bias roller 139 and the belt outside roller 138 are not limited to a roller mechanism and may be formed of a sliding mechanism using a rigid body.

Figure 4:
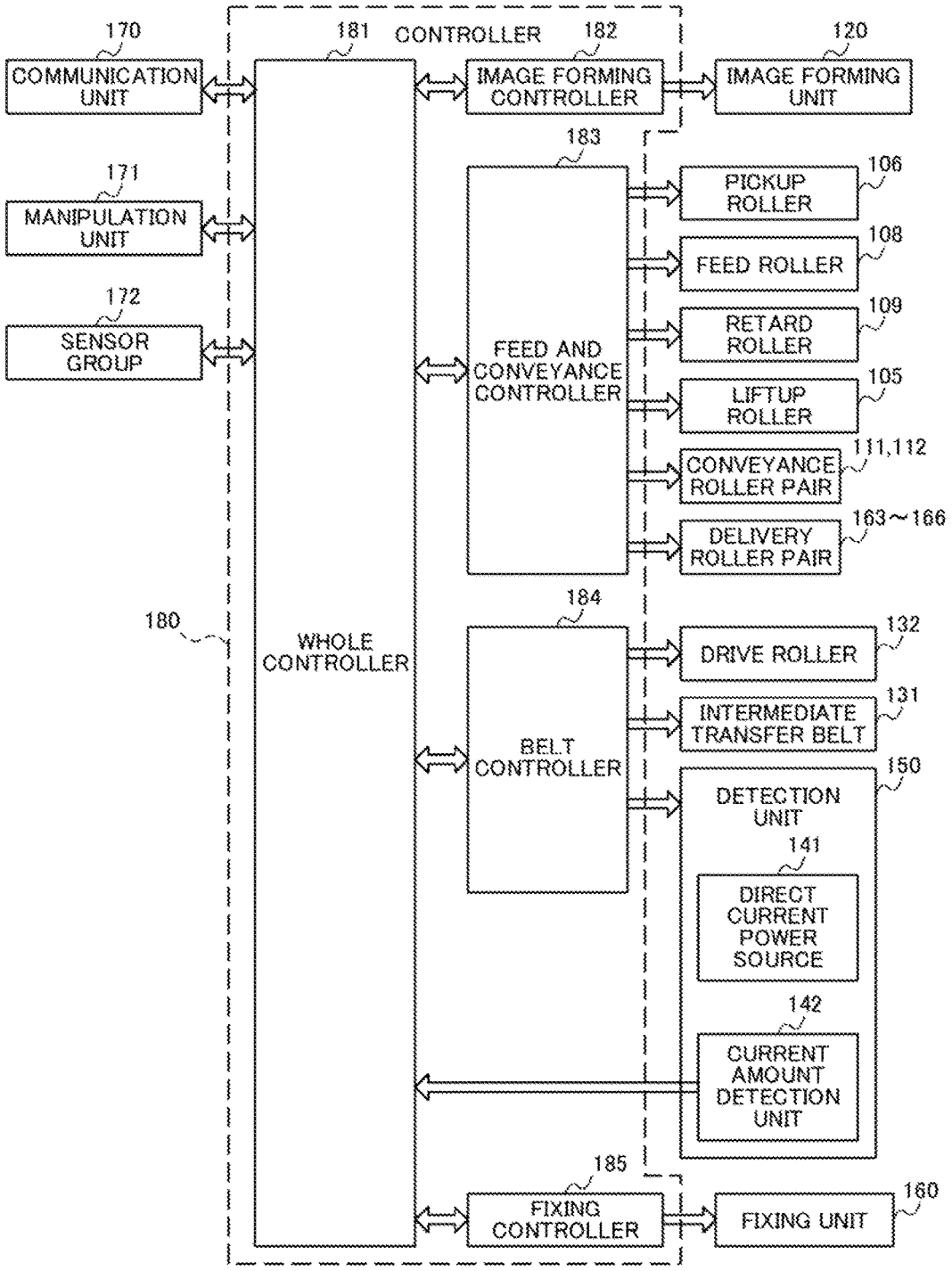
FIG. 4 is a block diagram showing an essential structure of a control system and a drive system of the image forming apparatus according to the first embodiment.

FIG. 4 is a block diagram showing an essential structure of a control system and a drive system of the image forming apparatus 100. A communication unit 170 communicates a host apparatus, not shown. For example, the communication unit 170 receives printing data and control commands from the host apparatus, not shown. A manipulation unit 171 includes, e.g., a display panel as a display unit for displaying states of the image forming apparatus 100, and entry keys as an input unit for entering instructions given from a user to the image forming apparatus 100. A sensor group 172 is made of various sensors monitoring operation state of the image forming apparatus 100, such as, e.g., a paper sensors 110, 168 for detecting the paper position, a write sensor, a temperature and humidity sensor, and a density sensor.

A controller 180 controls processing in the image forming apparatus 100. The controller 180 includes a whole controller 181, the image forming controller 182, the feed and conveyance controller 183, the belt controller 184, and the fixing controller 185. The controller 180 is constituted of one or more processing circuits having such as, e.g., a microprocessor, ROMs, RAMs, input output ports, and a timer.

The whole controller 181 controls processing of the entire image forming apparatus 100. For example, the whole controller 181 receives the printing data and the controller commands from the host apparatus, not shown, via the communication unit 170, and controls sequences of the entire image forming apparatus 100 to perform the printing operation.

The image forming controller 182 controls operations of the image forming unit 120 forming toner images according to the instructions of the whole controller 181, e.g., rotation operation of the photosensitive drum 121, and exposure operation of the exposure apparatus 123.

The feed and conveyance controller 183 controls operation of the various type rollers and the lift-up motor 105 according to the instructions from the whole controller 181. For example, the feed and conveyance controller 183 executes rotation operation of the pickup roller 106 and the feed roller 108, and torque generation operation of the retard roller 109, and picks up the paper 102 sheet by sheet. The feed and conveyance controller 183 controls rotation operation of the conveyance roller pairs 111, 112 and the delivery roller pairs 163 to 166 according to the instructions of the whole controller 181.

The belt controller 184 controls operation of the belt unit 130 and the detection unit 150 according to the instructions of the whole controller 181. For example, the belt controller 184 controls rotation operation of the drive roller 132 driving the intermediate transfer belt 131 and controls transfer voltage bias to the intermediate transfer belt 131 and direct current voltage bias to the detection unit 150. The whole controller 181 gives to the belt controller 184 the instruction for stopping the rotation operation of the drive roller 132 of the intermediate transfer belt 131 based on the detected result of the detection unit 150, or namely based on the current value detected by the current amount detection unit 142 of the detection unit 150. The belt controller 184 stops rotation drive of the drive roller 132 according to the instruction of the whole controller 181. With this operation, the intermediate transfer belt 131 stops running.

The fixing controller 185 controls the fixing unit 160 according to the instruction of the whole controller 181. For example, the fixing controller 185 controls the upper roller 161, the lower roller 162, and rotation drive sources of the upper roller 161 and the lower roller 162, as well as the power sources of the halogen lamps 161*a*, 162*a*.

Figure 5A:
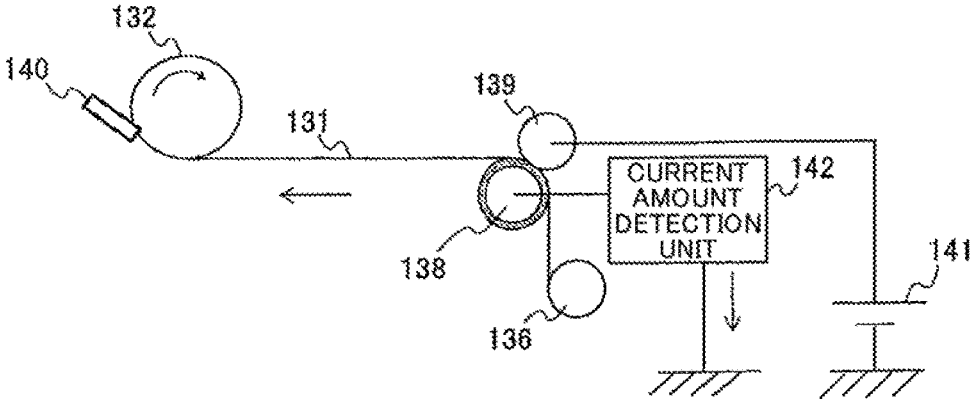
FIGS. 5A, 5B are schematic diagrams illustrating operation of the image forming apparatus according to the first embodiment.
Figure 5B:
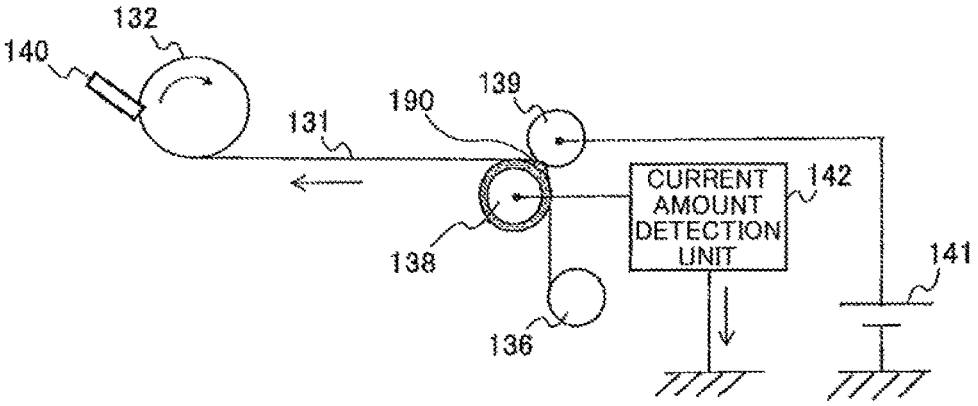

FIGS. 5A, 5B are schematic diagrams describing the operation of the image forming apparatus 100. FIG. 5A is a schematic diagram showing operation when no foreign object exists. Where no foreign object exists between the belt outside roller 138 and the intermediate transfer belt 131, close contact property is maintained between the intermediate transfer belt 131 and the belt outside roller 138. Accordingly, the current value i of the current flowing between the belt outside roller 138 and the bias roller 139 takes a value within a prescribed range as shown with following Formula (1).

$$I\text{min} \leq i \leq I\text{max} \qquad \text{Formula(1)}$$

In this situation, the whole controller 181 judges the current value i detected by the current amount detection unit 142 as the normal value, and judges or detects that no foreign object is attached to the intermediate transfer belt 131. The whole controller 181 provides the instruction executing the rotation operation of the drive roller 132 without providing any instruction stopping the printing operation to the belt controller 184. The belt controller 184 receiving such an instruction executes the rotation drive instruction of the drive roller 132 to rotationally drive the drive roller 132.

FIG. 5B is a schematic diagram showing operation when some foreign object exists. Where some foreign object 190 exists between the belt outside roller 138 and the intermediate transfer belt 131, a portion at which the close contact property between the intermediate transfer belt 131 and the belt outside roller 138 is partly not maintained can be generated. Accordingly, the current value i of the current flowing between the belt outside roller 138 and the bias roller 139 takes a value out of a prescribed range as shown with following Formula (2).

$$i < I\text{min or } I\text{max} < i \qquad \text{Formula(2)}$$

In this situation, the whole controller 181 judges the current value i detected by the current amount detection unit 142 as the abnormal value, and judges or detects that some foreign object is attached to the intermediate transfer belt 131. The whole controller 181 therefore provides an instruction stopping the rotation operation of the drive roller 132 to the belt controller 184. The belt controller 184, upon reception of such an instruction, executes the rotation stop instruction of the drive roller 132, and the drive roller 132 stops rotation drive before the foreign object 190 reaches the belt cleaning unit 140.

As described above, according to the first embodiment, where the value detected at the detection unit 150 indicates that the foreign object 190 attaches to the intermediate transfer belt 131, the foreign object 190 cannot reach the belt cleaning unit 140 and the image forming unit 120 by stopping the rotation drive of the drive roller 132 driving the intermediate transfer belt 131, thereby preventing those units from getting dirty or receiving damages.

Second Embodiment

The second embodiment is described next. It is to be noted that structures which is the same as those in the first embodiment are assigned with the same reference numbers, and the explanation thereof is omitted for the sake of brevity. For the operations and advantages the same as those in the first embodiment, the explanation is omitted for the sake of brevity.

Figure 6:
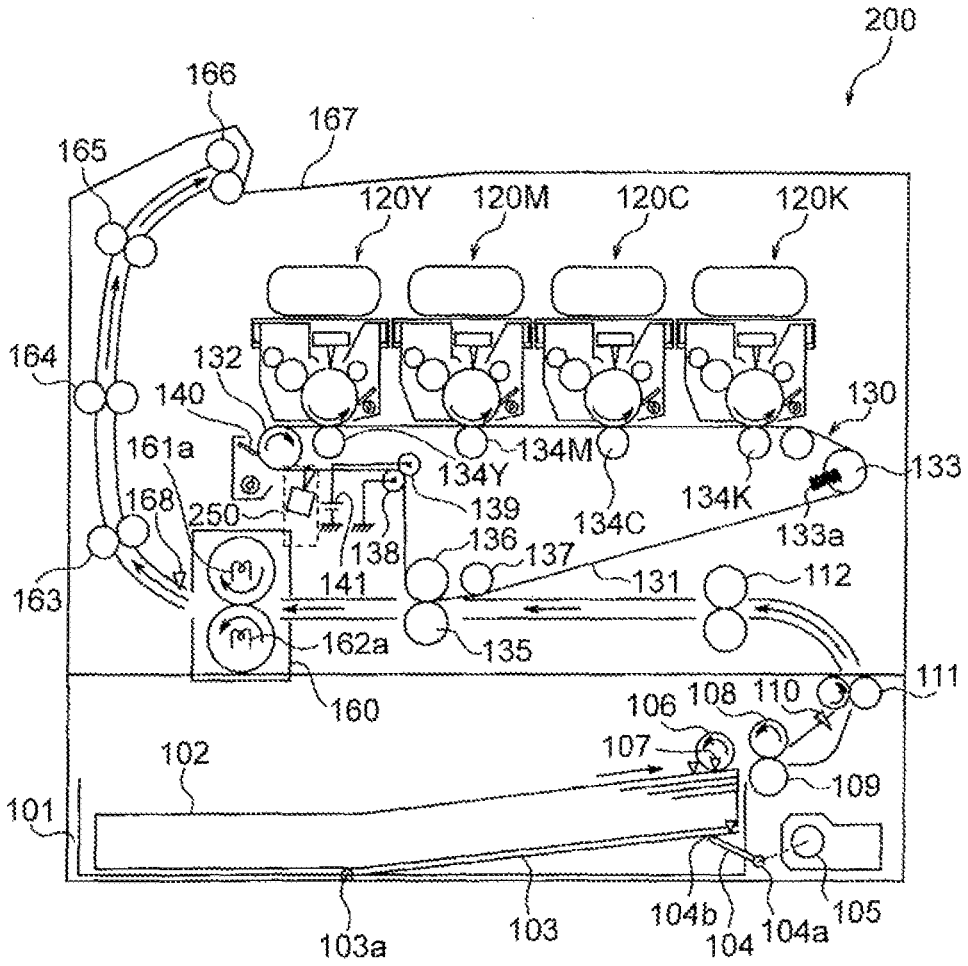
FIG. 6 is a schematic view showing a structure of an image forming apparatus according to a second embodiment of the invention.

FIG. 6 is a structural diagram showing structure of an image forming apparatus 200 according to the second embodiment. The image forming apparatus 200 according to the second embodiment has substantially the same structure as the image forming apparatus 100 according to the first embodiment except a detection unit 250.

Figure 7:
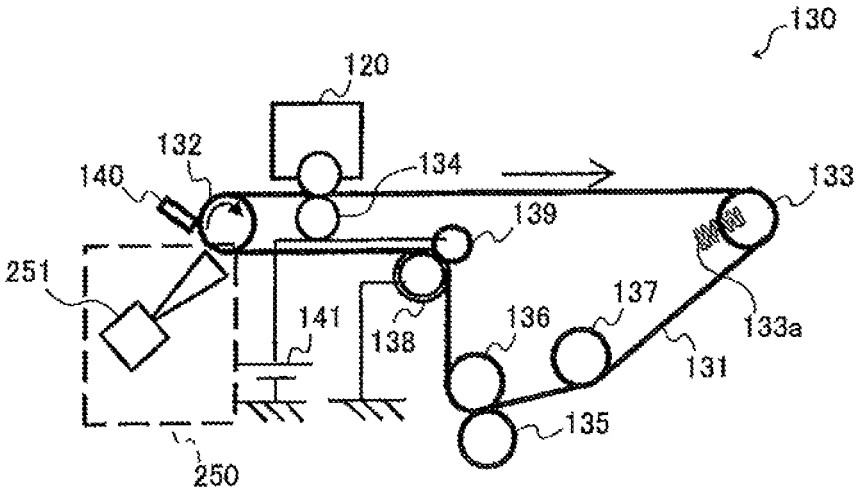
FIG. 7 is a schematic diagram showing a structure of a belt unit and a detection unit according to the second embodiment.

FIG. 7 is a schematic diagram showing the structure of the belt unit 130 and the detection unit 250. At the belt unit 130, disposed inside the intermediate transfer belt 131 are the drive roller 132, the tension roller 133, the primary transfer rollers 134, the secondary transfer backup roller 136, the guide roller 137, and the bias roller 139. The belt outside roller 138 is disposed outside the intermediate transfer belt 131 at the belt unit 130. With the belt unit 130, the direct current power source 141 is formed to apply a prescribed voltage between the bias roller 139 and the belt outside roller 138 to render the toner in an excessive amount not remain on the intermediate transfer belt 131.

The detection unit 250 according to the second embodiment detects, with photo sensors 251 serving as a light amount detection unit, a detection value for judging as to whether any foreign object is attached to the intermediate transfer belt 131 at a position on a downstream side of the secondary transfer roller 135 in the moving direction of the intermediate transfer belt 131 and on an upstream side of the belt cleaning unit 140 in the moving direction of the intermediate transfer belt 131. The plural photo sensors 251 face the outer surface as a surface on which some foreign object on the intermediate transfer belt 131 is to be detected, and are arranged in a line extending in a direction intersecting to the moving direction of the intermediate transfer belt 131, or namely, e.g., a rearward direction in FIG. 7. The photo sensors 251 herein are made of reflection type photo sensors, but can be made of transmission type photo sensors.

Figure 8:
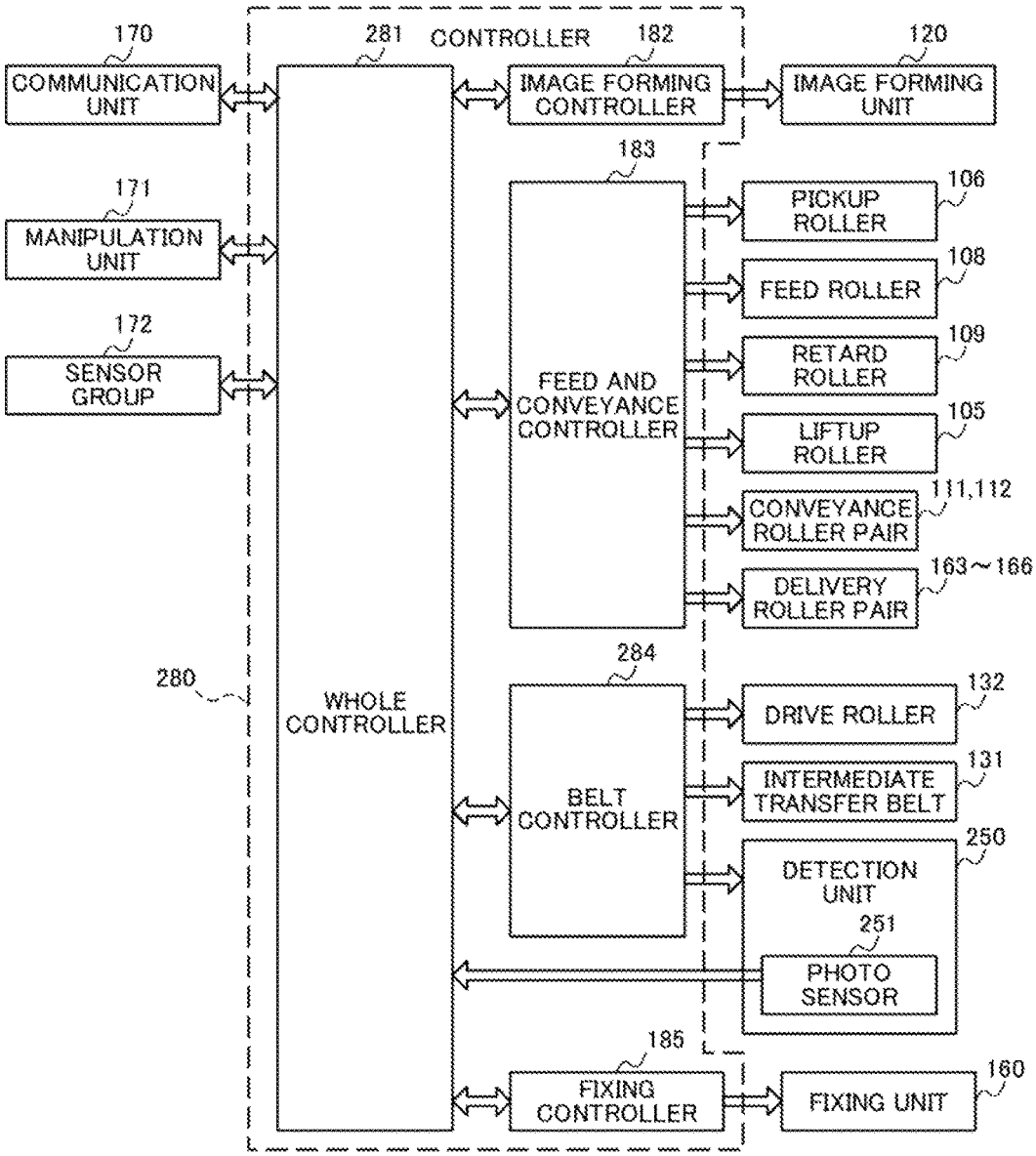
FIG. 8 is a block diagram showing an essential structure of a control system and a drive system of the image forming apparatus according to the second embodiment.

FIG. 8 is a block diagram showing an essential structure of the control system and the drive system of the image forming apparatus 200. The control system and the drive system of the image forming apparatus 200 according to the second embodiment are substantially the same as the control system and the drive system of the image forming apparatus 100 according to the first embodiment except a controller 280 and a detection unit 250. The controller 280 in the second embodiment has substantially the same structure as the controller 180 in the first embodiment except a whole controller 281 and a belt controller 284.

The belt controller 284 controls the detection unit 250 to render the photo sensor 251 output the detection value. The whole controller 281 provides, to the belt controller 184, the instruction stopping the rotation drive of the drive roller 132 of the intermediate transfer belt 131 based on the detection value of the photo sensor 251. The belt controller 184 stops the rotation drive of the drive roller 132 according to the instruction of the whole controller 181.

Figure 9A:
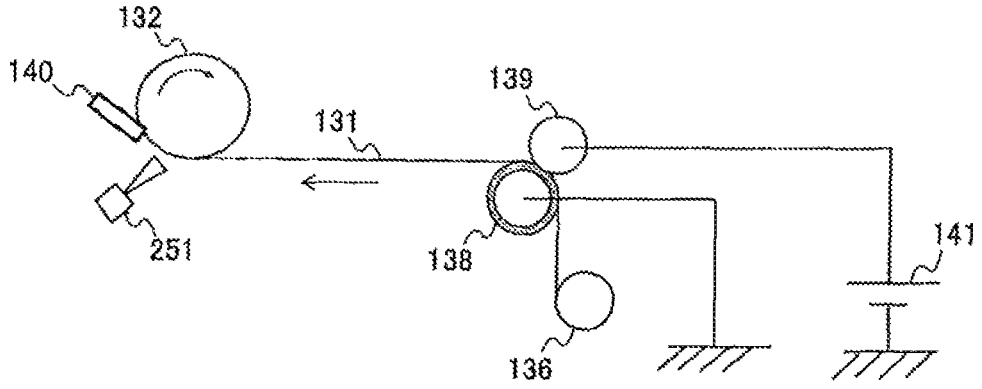
FIGS. 9A, 9B are schematic diagrams illustrating operation of the image forming apparatus according to the first embodiment.
Figure 9B:
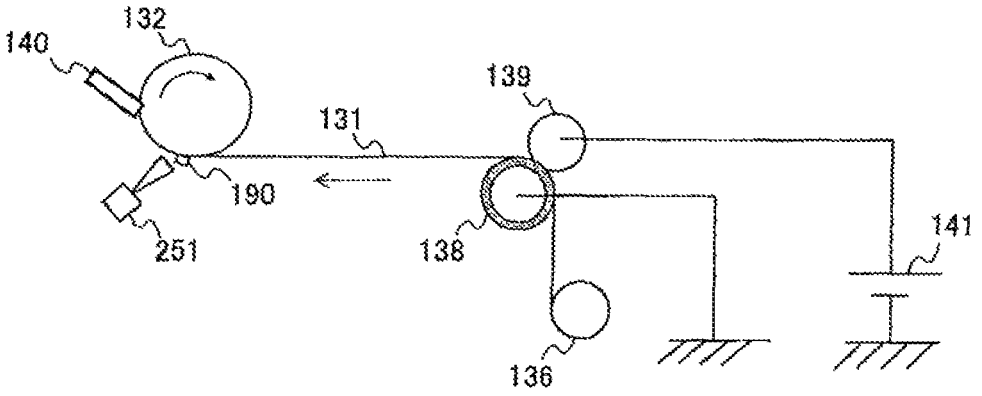

FIGS. 9A, 9B are schematic diagrams showing operation of the image forming apparatus 200. FIG. 9A is a schematic diagram showing operation when no foreign object exists. Where no foreign object exists between the belt outside roller 138 and the intermediate transfer belt 131, reflection rate r detected at the photo sensor 251 is set to a value within a prescribed range as shown by following Formula (3).

$$R\min \le r \le R\max \qquad \text{Formula(3)}$$

In this situation, the whole controller 281 judges the reflection rate r detected with the photo sensor 251 as the normal value, and judges as no foreign object is attached to the intermediate transfer belt 131. Therefore, the whole controller 281 provides an instruction executing the rotation drive of the drive roller 132 without providing any instruction stopping the rotation drive of the belt controller 284. The belt controller 284, upon receiving such an instruction, executes rotation drive instruction of the drive roller 132, thereby rotationally driving the drive roller 132.

FIG. 9B is a schematic diagram showing operation when some foreign object 190 exists. Where some foreign object 190 exists between the belt outside roller 138 and the intermediate transfer belt 131, the reflection rate r detected at the photo sensor 251 takes a value out of a prescribed range as shown with following Formula (4), according to the reflection light from the foreign object 190.

$$r < R\min \text{ or } R\max < r \qquad \text{Formula(4)}$$

In this situation, the whole controller 281 judges the reflection rate r detected with the photo sensor 251 as the abnormal value, and judges as some foreign object is attached to the intermediate transfer belt 131. Therefore, the whole controller 281 provides an instruction stopping the rotation drive of the drive roller 132 to the belt controller 284. The belt controller 284, upon receiving such an instruction, executes rotation stop instruction of the drive roller 132, and the drive roller 132 stops the rotation drive before the foreign object 190 reaches the belt cleaning unit 140.

The whole controller 281 may judge as some foreign object is attached if the abnormal value is detected at the photo sensors 251 in a prescribed number more than one among the photo sensors 251 arranged in the one line.

Although in the second embodiment the foreign object is detected by using the photo sensors 251, the foreign object may be detected with, e.g., use of a line sensor and image processing. In such a modification, the whole controller 281 may detect the foreign object based on image data given from the line sensor. Although in the second embodiment the reflection type photo sensor is used as the photo sensor 251, if a transmission type photo sensor is used as the photo sensor 251, transmission rate r is used in lieu of the reflection rate r described above.

Third Embodiment

A third embodiment is described next. Any explanation of structures in the third embodiment substantially the same as those in the first or second embodiment is omitted by assigning the same reference numbers to those in the first or second embodiment. Any explanation of operations and advantages of the third embodiment substantially the same as those in the first or second embodiments is also omitted for the sake of brevity.

Figure 10:
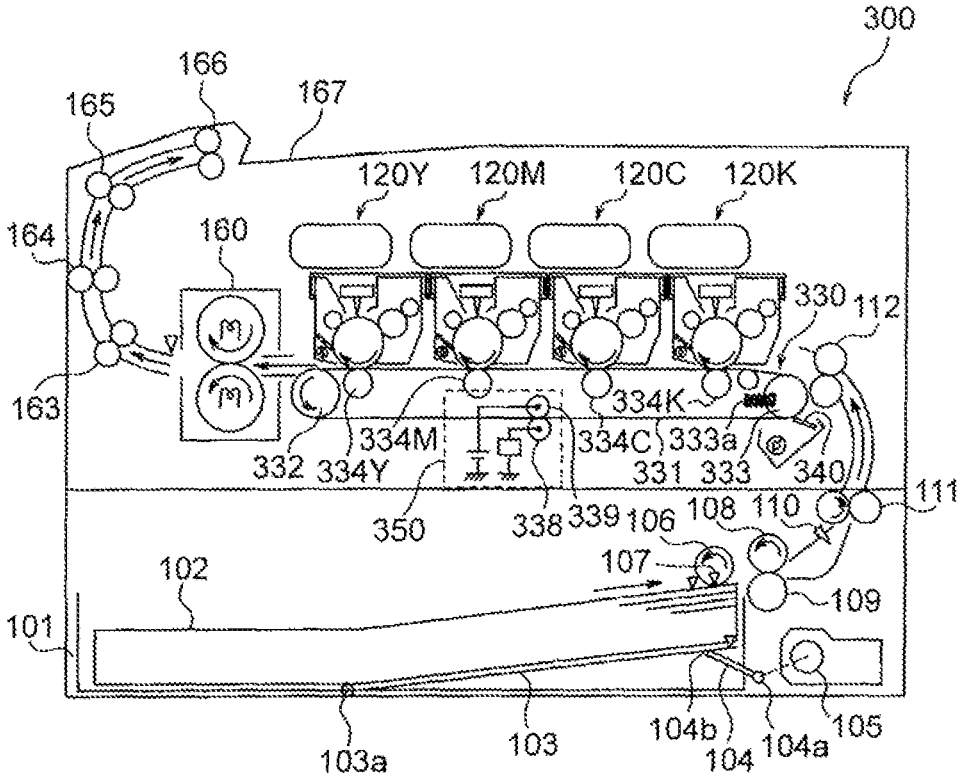
FIG. 10 is a schematic view showing a structure of an image forming apparatus according to a third embodiment of the invention.

FIG. 10 is a structural diagram showing structure of an image forming apparatus 300 according to the third embodiment. The image forming apparatus 300 according to the third embodiment has substantially the same structure as the image forming apparatus 100 according to the first embodiment or the image forming apparatus 200 according to the second embodiment except a belt detection unit 330 and a detection unit 350.

Figure 11:
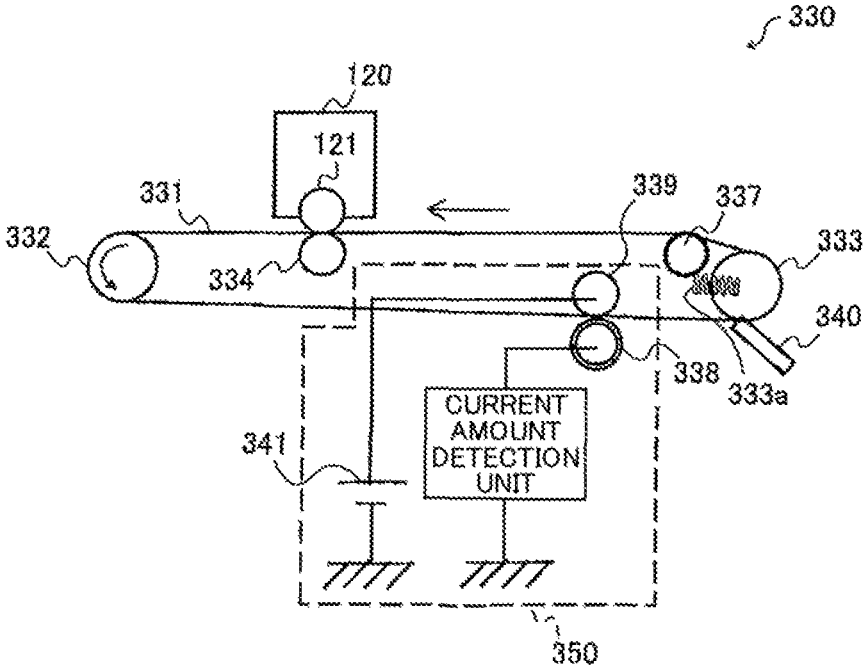
FIG. 11 is a schematic diagram showing a structure of a belt unit and a detection unit according to the third embodiment.

FIG. 11 is a schematic diagram showing the structures of the belt unit 330 and the detection unit 350 according to the third embodiment. The belt unit 330 includes a conveyance belt 331, a drive roller 332, a tension roller 333, transfer rollers 334, a guide roller 337, a bias roller 339, a belt outside roller 338, and a belt cleaning unit 340.

The conveyance belt 331 is tensioned by the drive roller 332, the tension roller 333, the transfer rollers 334, the guide roller 337, and the bias roller 339, and is a movable belt. The conveyance belt 331 is an endless belt conveying the paper 102 supplied from the conveyance roller pair 112. The conveyance belt 331 has a conductivity. In the third embodiment, the conveyance belt 331 is used in lieu of the intermediate transfer belt 131 in the first and second embodiments. The outer surface of the conveyance belt 331 is a surface conveying the paper 102.

The drive roller 332 is driven by a drive unit, not shown. The tension roller 333 provides tension to the conveyance belt 331 by an urging means such as, e.g., a coil spring 333*a*. The transfer roller 334 is a transfer member facing the photosensitive drum 121 and being biased with a prescribed voltage to transfer the toner images formed on the photosensitive drum 121 to the paper 102 conveyed with the conveyance belt 331.

The guide roller 337 guides the moving direction of the conveyance belt 331. The belt outside roller 338 contacts the outer surface of the conveyance belt 331. The bias roller 339 is disposed at a position opposing to the belt outside roller 338 astride the conveyance belt 331. The belt outside roller 338 and the bias roller 339 closely contact the conveyance belt 331.

The belt cleaning unit 340 removes toners attached to the conveyance belt 331. A direct current power source 341 is provided for applying a prescribed voltage between the bias roller 339 and the belt outside roller 338 to render not remain on the conveyance belt 331 the toner in an excessive amount. A current amount detection unit 342 is provided at the belt unit 330 for detecting an amount of current flowing between the bias roller 339 and the belt outside roller 338. The bias roller 339, the belt outside roller 338, the direct current power source 341, and the current amount detection unit 342 function as the detection unit 350 detecting the value for detecting any foreign object attached to the conveyance belt 331. The detection unit 350 is disposed on a downstream side of the transfer roller 334 in the moving direction of the conveyance belt 331 and on an upstream side of the belt cleaning unit 340 in the moving direction of the conveyance belt 331.

It is to be noted that the control system and the drive system of the image forming apparatus 300 according to the third embodiment are substantially the same as those in the first embodiment. The belt controller 184 shown in FIG. 4, however, controls operation of the conveyance belt 331 in lieu of the intermediate transfer belt 131. The belt controller 184 controls the operation of the belt unit 330.

Figure 12A:
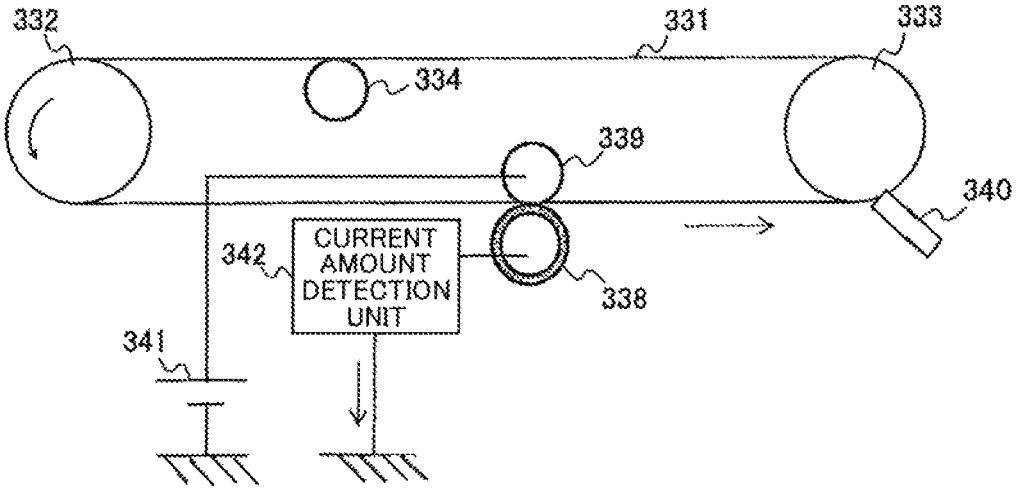
FIGS. 12A, 12B are schematic diagrams illustrating operation of the image forming apparatus according to the third embodiment.
Figure 12B:
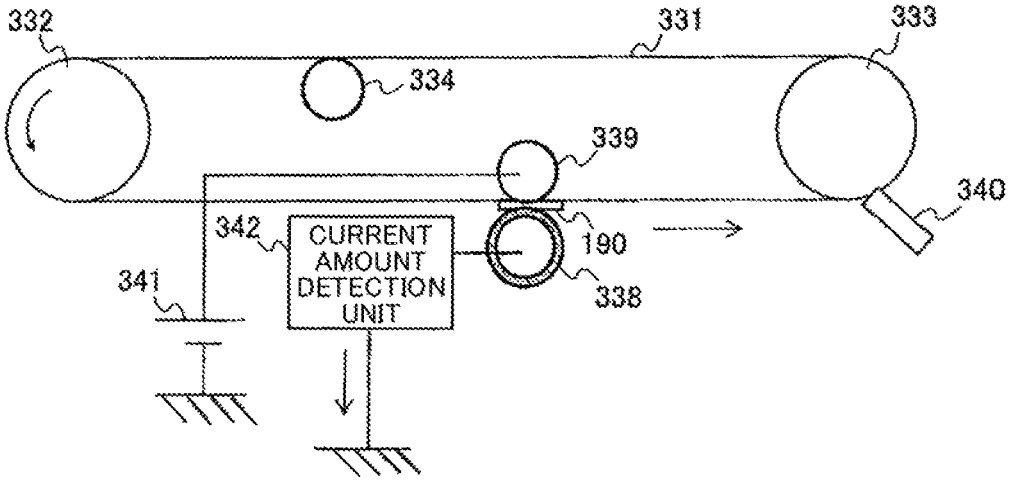

FIGS. 12A, 12B are schematic diagrams describing operation of the image forming apparatus 300. FIG. 12A is a schematic diagram showing operation when no foreign object exists. Where no foreign object exists between the belt outside roller 338 and the conveyance belt 331, close contact property is maintained between the conveyance belt 331 and the belt outside roller 338. Accordingly, the current value i of the current flowing between the belt outside roller 338 and the bias roller 339 takes a value within a prescribed range likewise above Formula (1).

In this situation, the whole controller 181 judges the current value i detected by the current amount detection unit 342 as the normal value. The whole controller 181 provides the instruction executing the rotation operation of the drive roller 332 without providing any instruction stopping the printing operation to the belt controller 184. The belt controller 184 upon receiving such an instruction executes the rotation drive instruction of the drive roller 332 to rotationally drive the drive roller 332.

FIG. 12B is a schematic diagram showing operation when some foreign object exists. Where some foreign object 190 exists between the belt outside roller 338 and the conveyance belt 331, a portion at which the close contact property between the conveyance belt 331 and the belt outside roller 338 is partly not maintained can be generated. The current value i of the current flowing between the belt outside roller 338 and the bias roller 339 therefore takes a value out of a prescribed range likewise above Formula (2), in accordance with the conductivity of the foreign object.

In this situation, the whole controller 181 judges the current value i detected by the current amount detection unit 342 as the abnormal value. The whole controller 181 therefore provides an instruction stopping the rotation operation of the drive roller 332 to the belt controller 184. The belt controller 184, upon reception of such an instruction, executes the rotation stop instruction of the drive roller 332, and the drive roller 332 stops rotation drive before the foreign object 190 reaches the belt cleaning unit 340.

As described above, according to the third embodiment, where the value detected at the detection unit 350 indicates that the foreign object 190 attaches to the conveyance belt 331, the foreign object 190 cannot reach the belt cleaning unit 340 and the image forming unit 120 by stopping the rotation drive of the drive roller 332 driving the conveyance belt 331, thereby preventing those units from getting dirty or receiving damages.

Fourth Embodiment

A fourth embodiment is described next. Any explanation of structures in the fourth embodiment substantially the same as those in any of the first to third embodiments is omitted by assigning the same reference numbers to those in the first, second, or third embodiment. Any explanation of operations and advantages of the fourth embodiment substantially the same as those in any of the first to third embodiments is also omitted for the sake of brevity.

Figure 13:
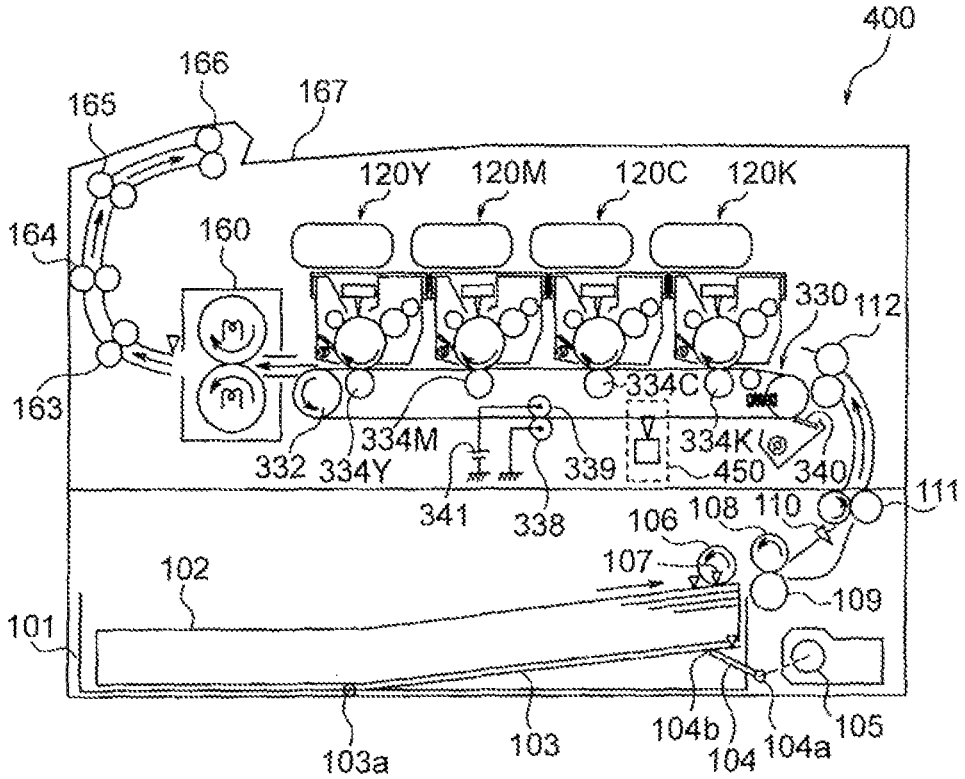
FIG. 13 is a schematic view showing a structure of an image forming apparatus according to a fourth embodiment of the invention.
Figure 14:
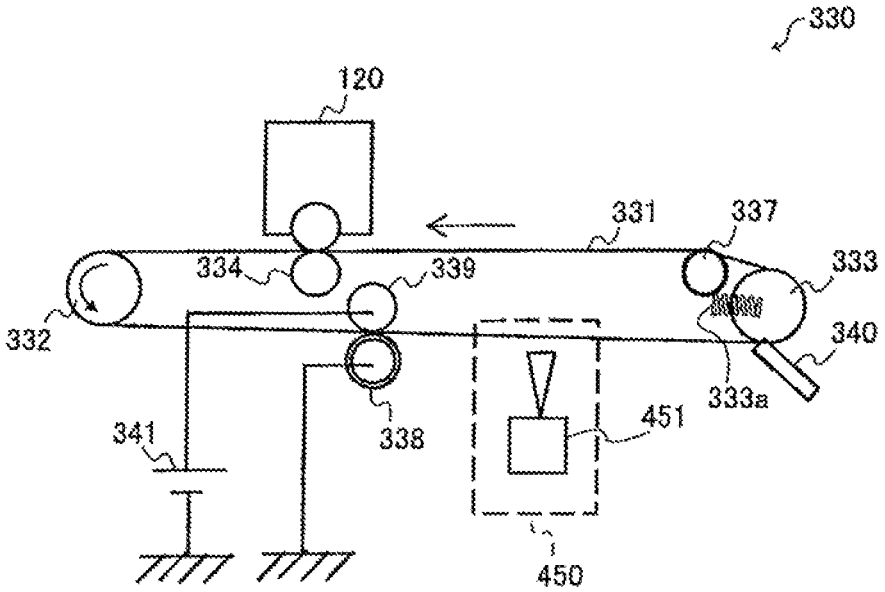
FIG. 14 is a schematic diagram showing a structure of a belt unit and a detection unit according to the fourth embodiment.

FIG. 13 is a structural diagram showing structure of an image forming apparatus 400 according to the fourth embodiment. The image forming apparatus 400 according to the fourth embodiment has substantially the same structure as the image forming apparatus 300 according to the third embodiment except a detection unit 450. FIG. 14 is a schematic diagram showing the structures of the belt unit 330 and the detection unit 450. The belt unit 330 has substantially the same structure as that in the third embodiment.

The detection unit 450 according to fourth embodiment detects, with photo sensors 451 serving as a light amount detection unit arranged in a line extending rearward in FIG. 14, a detection value for detecting any foreign object on the conveyance belt 331 at a position on a downstream side of the transfer roller 334 in the moving direction of the conveyance belt 331 and on an upstream side of the belt cleaning unit 340 in the moving direction of the conveyance belt 331. The photo sensors 451 herein are made of reflection type photo sensors, but can be made of transmission type photo sensors.

The control system and the drive system of the image forming apparatus 400 according to the fourth embodiment are substantially the same as those according to the second embodiment. The belt controller 284 shown in FIG. 8 controls the operation of the conveyance belt 331 in lieu of the intermediate transfer belt 131.

Figure 15A:
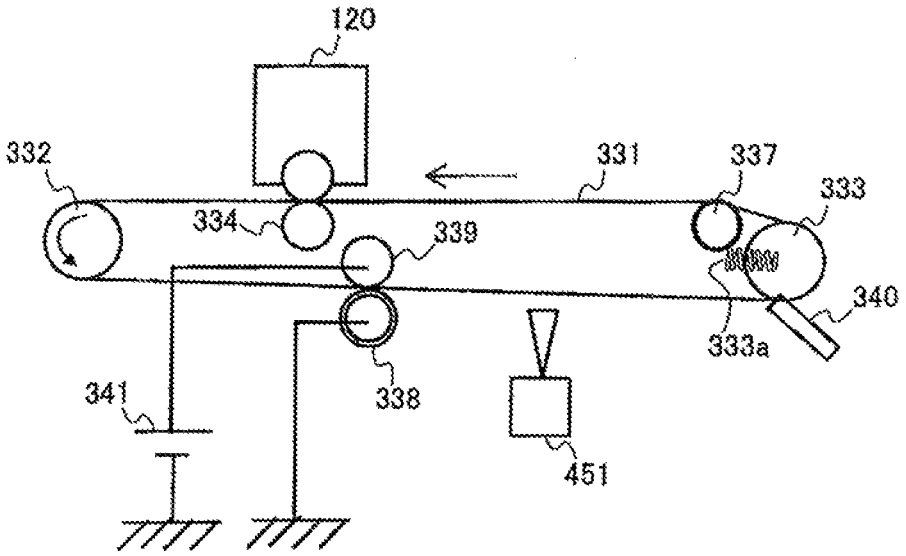
FIGS. 15A, 15B are schematic diagrams illustrating operation of the image forming apparatus according to the fourth embodiment.
Figure 15B:
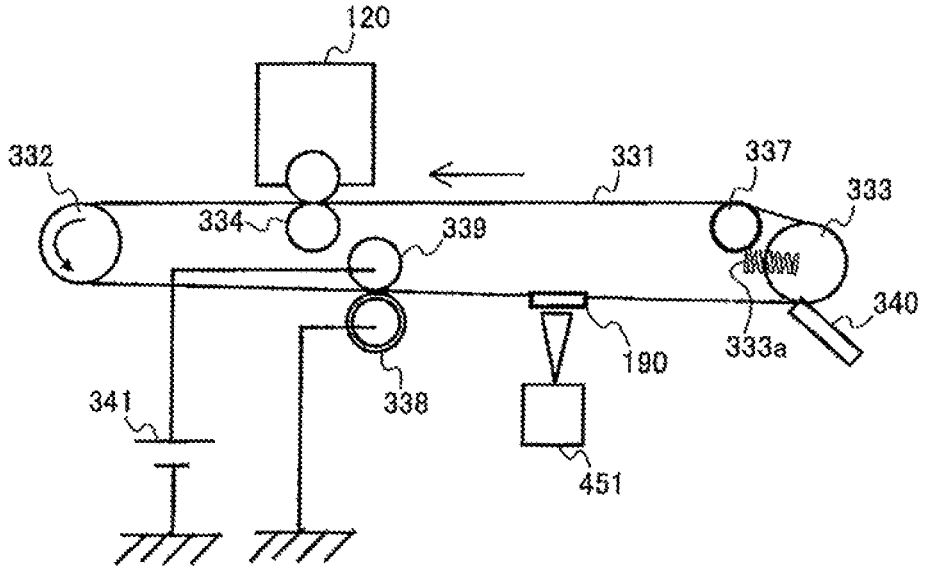

FIGS. 15A, 15B are schematic diagrams showing operation of the image forming apparatus 400 according to the fourth embodiment. FIG. 15A is a schematic diagram showing operation when no foreign object exists. Where no foreign object exists between the belt outside roller 338 and the conveyance belt 331, reflection rate r detected at the photo sensor 451 is set to a value within a prescribed range as shown by above Formula (3).

In this situation, the whole controller 281 judges the reflection rate r detected with the photo sensor 451 as the normal value. Therefore, the whole controller 281 provides an instruction executing the rotation drive of the drive roller 332 without providing any instruction stopping the printing operation of the belt controller 284. The belt controller 284, upon receiving such an instruction, executes rotation drive instruction of the drive roller 332, thereby rotationally driving the drive roller 332.

FIG. 15B is a schematic diagram showing operation when some foreign object 190 exists. Where some foreign object 190 exists between the belt outside roller 338 and the conveyance bell 331, the reflection rate r detected at the photo sensor 451 takes a value out of a prescribed range likewise above Formula (4), according to the reflection light from the foreign object 190.

The whole controller 281 therefore judges the reflection rate r detected with the photo sensor 251 as the abnormal value. The whole controller 281 provides an instruction stopping the rotation drive of the drive roller 332 to the belt controller 284. The belt controller 284, upon receiving such an instruction, executes rotation stop instruction of the drive roller 332, and the drive roller 332 stops the rotation drive before the foreign object 190 reaches the belt cleaning unit 340.

The whole controller 281 may judge as some foreign object exists if the abnormal value is detected at the photo sensors 451 in a prescribed number among the photo sensors 251 arranged in the one line.

Although in the fourth embodiment the foreign object is detected by using the photo sensors 451, the foreign object may be detected with, e.g., use of a line sensor and image processing. In such a modification, the whole controller 281 may detect the foreign object based on image data given from the line sensor. Although in the fourth embodiment the reflection type photo sensor is used as the photo sensor 451, if a transmission type photo sensor is used as the photo sensor 251, transmission rate r is used in lieu of the reflection rate r described above.

Fifth Embodiment

A fifth embodiment is described next. Any explanation of structures in the fifth embodiment substantially the same as those in any of the first to fourth embodiments is omitted by assigning the same reference numbers to those in any of the first to fourth embodiments. Any explanation of operations and advantages of the fifth embodiment substantially the same as those in any of the first to fourth embodiments is also omitted for the sake of brevity.

Figure 16:
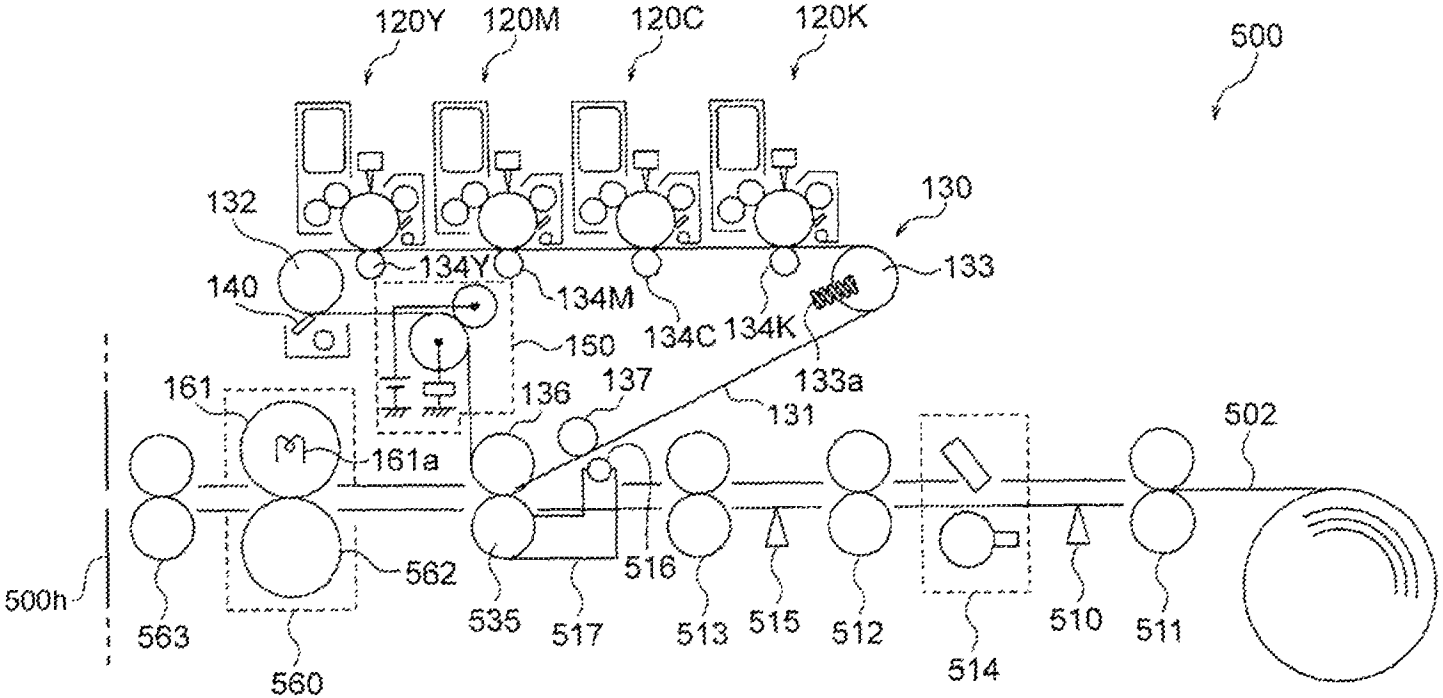
FIG. 16 is a schematic view showing an essential structure of an image forming apparatus according to a fifth embodiment of the invention.

FIG. 16 is a schematic diagram showing an essential structure of an image forming apparatus 500 according to the fifth embodiment. A paper 502 according to the fifth embodiment is a series of sheets, or namely a web form in a roll shape. In the paper 502, labels are adhered to a base paper, and images are formed to the labels. The paper 502 is conveyed in a left direction in FIG. 16 by conveyance roller pair 511. A paper sensor 510 is made of a transmission type sensor formed of a light emission element and a light receiving sensor, or a reflection type sensor detecting reflection intensity, and detects a reference mark formed on the paper 502 or an edge of the label formed with the same interval on the paper 502. A cutter unit 514 is a rotary type cutter unit, and is a cutting member capable of cutting the paper 502 without stopping the paper 502. The cutter unit 514 is disposed on an upstream side of the secondary transfer roller 535 described below in the conveyance route of the paper 502. The cutter unit 514 is controlled to make adjustable a cutting portion based on the detected result of the paper sensor 510 according to the position of the reference mark or the edge of the label.

Another paper sensor 515 is disposed between a conveyance roller pair 512 and a conveyance roller pair 513. The paper sensor 515 is made of the transmission type sensor or the reflection type sensor in substantially the same way as the paper sensor 510. The timing of the image formation at the image forming unit 120 is decided based on the detected result of the paper sensor 510 and the paper sensor 515. It is to be noted that the conveyance roller pairs 511, 512, 513 are positioned on an upstream side of the cutter unit 514 in the conveyance route of the paper 502, and function as upstream side rollers conveying the paper 502 to the cutter unit 514.

The image forming unit 120 sequentially forms toner images in black, cyan, magenta, and yellow, and transfers the toner images to the intermediate transfer belt 131. The image forming unit 120 is substantially the same as the image forming unit 120 in the first embodiment. The image forming unit 120 is attached to a top of the belt unit 130. The belt unit 130 is substantially the same as the belt unit 130 in the first embodiment. The belt cleaning unit 140 and the detection unit 150 are provided in the belt unit 130. The belt cleaning unit 140 and the detection unit 150 according to the fifth embodiment have substantially the same structures as the belt cleaning unit 140 and the detection unit 150 according to the first embodiment.

The belt unit 130 transfers the toner images formed with the image forming units 120 to the intermediate transfer belt 131, and further transfers the toner images to the paper 502 supplied from the conveyance roller pair 513. The toner images transferred to the intermediate transfer belt 131 are transferred to the labels of the paper 502 in application of the prescribed voltage to the secondary transfer roller 535 provided as to oppose the secondary transfer backup roller 136. The secondary transfer roller 535 functions as a transfer unit transferring the toner images to the paper 502.

Figure 17:
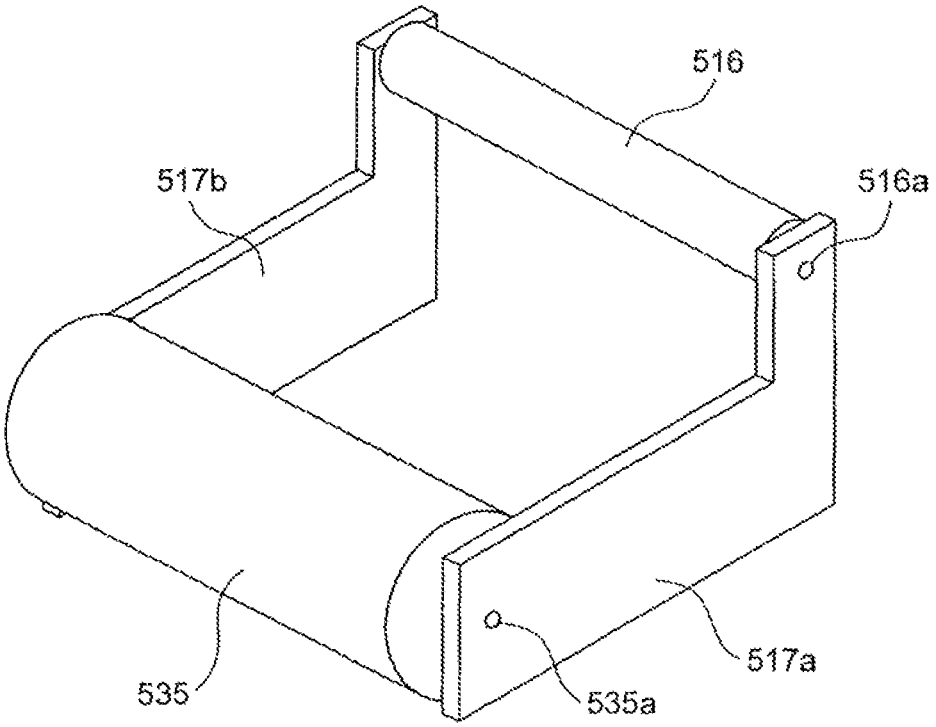
FIG. 17 is a perspective view showing a secondary roller, a support bar, and a support frame according to the fifth embodiment of the invention.

A support bar 516 is arranged above a conveyance route of the paper 502. An end of the secondary transfer roller 535 and an end of the support bar 516 are rotatably supported at a support frame 517. FIG. 17 is a perspective view showing the secondary transfer roller 535, the support bar 516, and the support frame 517. As shown in FIG. 17, the support frame 517 includes a first frame 517*a*, and a second frame 517*b*. The secondary transfer roller 535 and the support bar 516 are disposed between the first frame 517*a* and the second frame 517*b*. A rotary shaft 535*a* of the secondary transfer roller 535 and a rotary shaft 516*a* of the support bar 516 are provided as to extend in parallel to each other, and the first frame 517*a* and the second frame 517*b* support rotatably the rotary shaft 535*a* and the rotary shaft 516*a*, respectively.

Figure 18A:
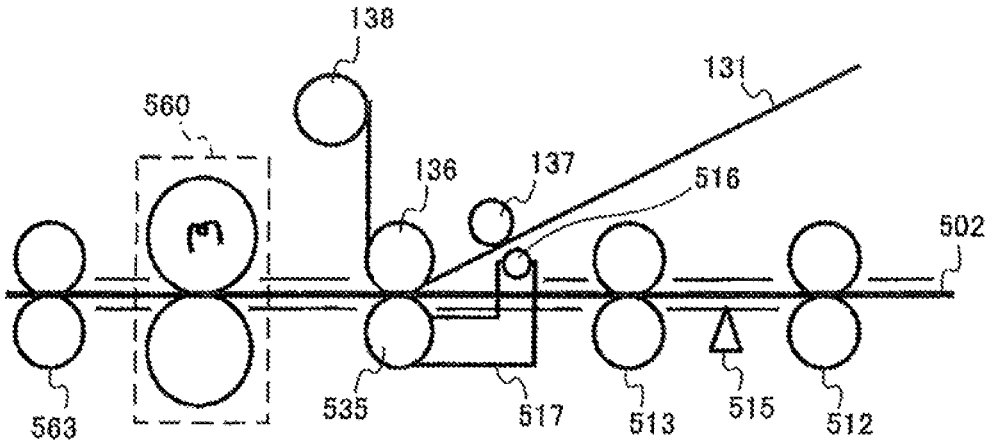
FIGS. 18A, 18B are schematic diagrams illustrating states of the support frame in an up and down motion operation according to the fifth embodiment.
Figure 18B:
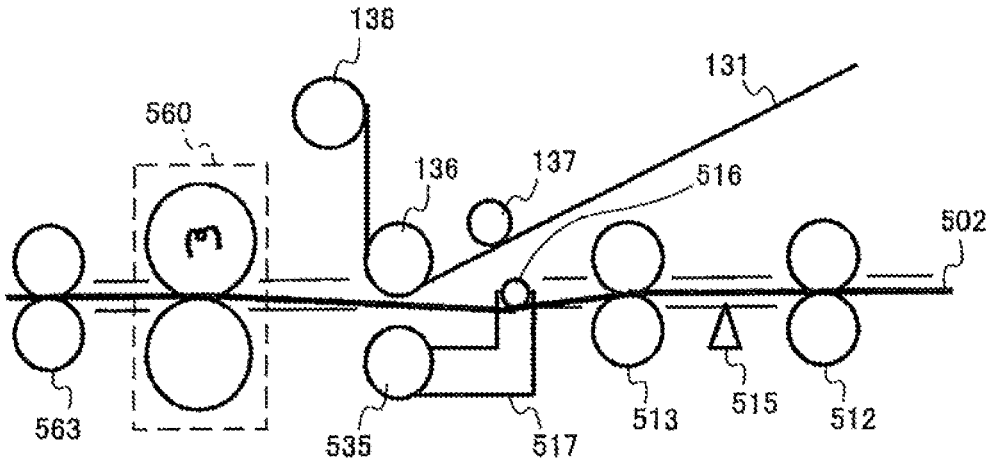
Figure 19:
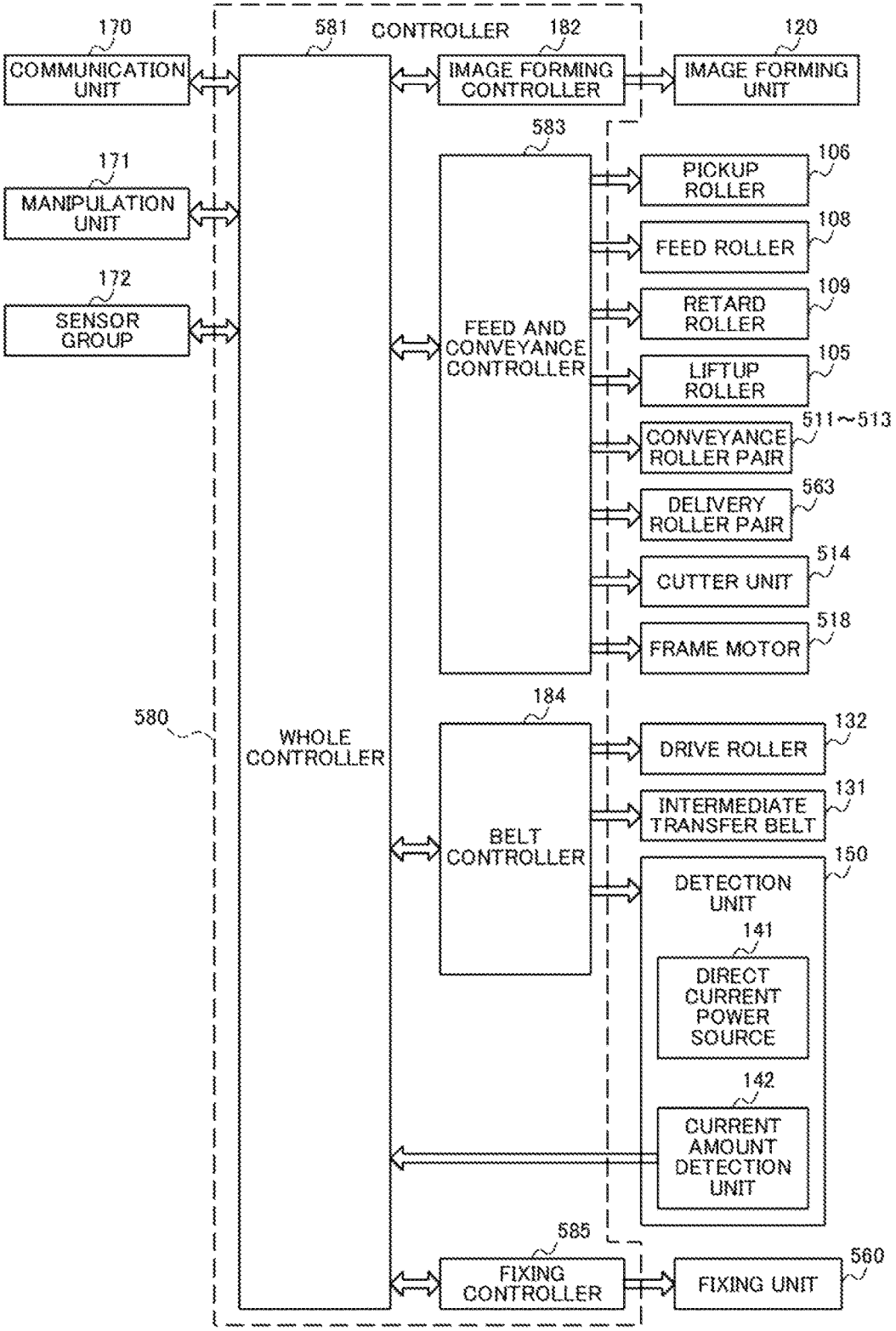
FIG. 19 is a block diagram showing an essential structure of a control system and a drive system of the image forming apparatus according to the fifth embodiment.

The support frame 517 is driven in an up and down direction by drive force from a frame motor 518 (see FIG. 19) serving as a frame drive unit according to control from a feed and conveyance controller 583 (see FIG. 19). FIGS. 18A, 18B are schematic diagrams showing states that the support frame 517 is moved up and down. FIG. 18A is a schematic diagram showing a state that the support frame 517 is located at a first portion on an upper side. As shown in FIG. 18A, where the support frame 517 is placed at the first position, the secondary transfer roller 535 is at a position closely contacting the paper 502 located on an upper side of the secondary transfer roller 535, and the paper 502 is sandwiched between the secondary transfer roller 535 and the intermediate transfer belt 131. Where the support frame 517 is at the first portion, the first position can be referred to as the image forming position for forming images because the images are transferred to the paper 502.

FIG. 18B is a schematic diagram showing a state that the support frame 517 is located at a second position on a lower side. As shown in FIG. 18B, the support frame 517 is located at the second position, the secondary transfer roller 535 is at the position not closely contacting and away from the paper 502 below the paper 502. Where the support frame 517 is at the second position, the paper 502 is separated downward from the intermediate transfer belt 131 upon pulling down the paper 502 with the support bar 516. Thus, where the support frame 517 is located at the second position, the paper 502 separates from the secondary transfer roller 535 and the intermediate transfer belt 131, and because no image is formed, the second position can be referred to as an escaping position at which no image is formed. As described above, where the support frame 517 moves from the first position to the second position, the support bar 516 moves the paper 502 in a direction away from the intermediate transfer belt 131.

As described above, the secondary transfer roller 535, the support bar 516, the support frame 517, and the frame motor 518 (see FIG. 19) changing the positions of those members function as a moving unit for moving the paper 502 to a position not contacting the intermediate transfer belt 131 where the controller detects the attachment of the foreign object to the intermediate transfer belt 131.

A fixing unit 560 shown in FIG. 16 includes inside a halogen lamp 161*a* serving as a heat source, and is made of a roller pair of an upper roller 161 and a lower roller 562 having a respective surface made of an elastic body. The fixing unit 560 melts the toner images in application of the heat and pressure to the toner image on the paper 502, and fixes the images to the paper 502. It is to be noted that the operations of the respective parts of the fixing unit 500 are controlled by the fixing controller 185 (see. FIG. 19) as described below. Subsequently, the paper 502 is conveyed by the delivery roller pair 563 and is delivered to an exterior of an apparatus housing 500*h* of the image forming apparatus 500. The delivery roller pair 563 is located on a downstream side of the cutter unit 514 in the conveyance route of the paper 502 and functions as a downstream side roller delivering the cut paper 502 to the exterior of the image forming apparatus 500.

FIG. 19 is a block diagram showing an essential structure of a control system and a drive system of the image forming apparatus 500 according to the fifth embodiment. The control system and the drive system of the image forming apparatus 500 according to the fifth embodiment have substantially the same structures as the control system and the drive system of the image forming apparatus 100 according to the first embodiment except that the controller 580 controls the conveyance roller pairs 511, 512, 513, the delivery roller pair 563, the cutter unit 514, the frame motor 518, and the fixing unit 560. The controller 580 according to the fifth embodiment has substantially the same structure as the controller 180 in the first embodiment except the whole controller 581, the feed and conveyance roller controller 583, and the fixing controller 585.

The whole controller 581 controls the processing of the entire image forming apparatus 500. The whole controller 581 performs processing substantially the same as the processing done at the whole controller 181 in the first embodiment and does the control described below. The whole controller 581, in substantially the same way as the first embodiment, detects some foreign object according to current value from the detection unit 150. The whole controller 581 provides an instruction to the feed and conveyance controller 583 where some foreign object is detected, thereby stopping the move of the intermediate transfer belt 131, and moving the support frame 517 downward to render the paper 502 away from the intermediate transfer belt 131. The whole controller 581 instructs the feed and conveyance controller 583 to render the cutter unit 514 cut the paper 502, thereby stopping the drive of the conveyance roller pair 511 after the cutting operation, and driving the conveyance roller pairs 512, 513 and the delivery roller pair 563 to discharge the remaining paper 502 to the exterior of the apparatus housing. The whole controller 581 instructs the feed and conveyance controller 583 to stop the drives of the conveyance roller pairs 512, 513 and the delivery roller pair 563 after the delivery of the paper 502.

The feed and conveyance controller 583 controls operations of the various rollers, the lift-up motor 105, the cutter unit 514, and the frame motor 518 according to the instructions of the whole controller 581. The fixing controller 585 controls the fixing unit 560 according to the instruction of the whole controller 581.

Figure 20:
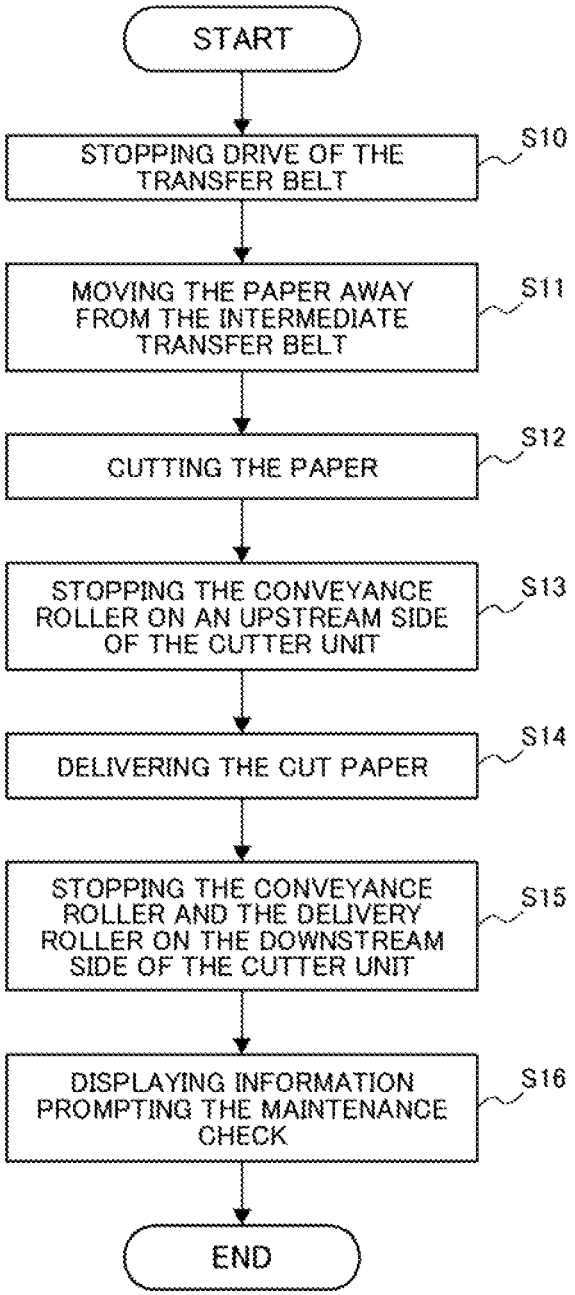
FIG. 20 is a flowchart showing a processing when a whole controller detects a foreign object according to the fifth embodiment

FIG. 20 is a flowchart showing a processing where the whole controller 581 detects some foreign object. In the flowchart shown in FIG. 20, the processing starts where the whole controller 581 detects some foreign object, or in other words, when the current value from the current amount detection unit 142 takes a value out of the prescribed range.

The whole controller 581 provides an instruction to the belt controller 184 to stop the move of the intermediate transfer belt 131 (Step S10). The belt controller 184, upon receiving such an instruction, stops the move of the intermediate transfer belt 131.

The whole controller 581 provides an instruction to the feed and conveyance controller 583 to render the paper 502 away from the intermediate transfer belt 131 (Step S11). The feed and conveyance controller 583, upon receiving such an instruction, drives the frame motor 518, and moves the support frame 517 from the first position to the second position. With this operation, the support bar 516 pushes down the paper 502, thereby rendering the paper 502 away from the intermediate transfer belt 131.

The whole controller 581 provides an instruction to the feed and conveyance controller 583 to cut the paper 502 (Step S12). The feed and conveyance controller 583, upon receiving such an instruction, drives the cutter unit 514 based on the detected result of the paper sensor 510, thereby cutting the paper 502 at the base portion at the interval between the labels.

The whole controller 581 provides an instruction to the feed and conveyance controller 583 to stop the drive of the conveyance roller pair 511 located on the upstream side of the cutter unit 514 in the conveyance route of the paper 502 (Step S13). The feed and conveyance controller 583, upon receiving such an instruction, stops the drive of the conveyance roller pair 511.

The whole controller 581 provides an instruction to the feed and conveyance controller 583 to maintain the drives of the conveyance roller pairs 512, 513 and the delivery roller pair 563 located on the downstream side of the cutter unit 514 in the conveyance route of the paper 502, thereby delivering or discharging the cut paper 502 (Step S14).

After delivery of the paper 502, the whole controller 581 provides an instruction to the feed and conveyance controller 583 to stop the drives of the conveyance roller pairs 512, 513 and the delivery roller pair 563 located on the downstream side of the cutter unit 514 in the conveyance route of the paper 502 (Step S15). The feed and conveyance controller 583, upon receiving such an instruction, stops the drives of the conveyance roller pairs 512, 513 and the delivery roller pair 563.

The whole controller 581 displays information prompting a maintenance check on a display panel of the manipulation unit 171 (Step S16). For example, the display panel desirably displays information prompting a maintenance check of the belt unit 130.

As described above, according to the fifth embodiment, by discharging the remaining paper 502 where the belt unit 130 becomes abnormal, any work to remove the paper 502 remained by the user may become unnecessary, thereby reducing the down or inactive time.

Although in the fifth embodiment described above, the detection unit 150 as set forth in the first embodiment is used, the detection unit 250 as set forth in the second embodiment may be used.

In the first to fifth embodiments as described above, the four image forming units 120 are used, but the number of the image forming units is not limited to this example. For example, solo image forming unit 120 may be provided in the first to fifth embodiments.

The image forming apparatus 100 to 500 according to the first to fifth embodiments described above can be printers, MFPs (Multifunction peripherals), facsimile machines, and photocopiers.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing descriptions of the embodiments according to the present invention are provided for illustration only, and not for the purpose of limiting the invention as defined by the appended claims and their equivalents.

What is claimed is:

1. An image forming apparatus comprising:

a movable endless belt;

an image forming unit forming a developer image;

a transfer unit transferring the developer image to a medium on a downstream side of the image forming unit in a moving direction of the belt;

a belt cleaning unit cleaning the belt on a downstream side of the transfer unit in the moving direction of the belt;

a detection unit detecting a surface state of the belt on a downstream side of the transfer unit in the moving direction of the belt and on an upstream side of the belt cleaning unit in the moving direction of the belt; and a control unit stopping move of the belt where a detected result at the detection unit indicates attachment of any foreign object to the belt.

2. The image forming apparatus according to claim 1, wherein the control unit stops move of the belt before the foreign object reaches the belt cleaning unit.

3. An image forming apparatus comprising:

a movable endless belt;

an image forming unit forming a developer image;

a transfer unit transferring the developer image to a medium on a downstream side of the image forming unit in a moving direction of the belt;

a belt cleaning unit cleaning the belt on a downstream side of the transfer unit in the moving direction of the belt;

a detection unit detecting a surface state of the belt on a downstream side of the transfer unit in the moving direction of the belt and on an upstream side of the belt cleaning unit in the moving direction of the belt and the detection unit detects a value detecting as to whether any foreign object is attached to a surface of the belt; and a control unit stopping move of the belt based on a result detected at the detection unit.

4. The image forming apparatus according to claim 3, wherein the detection unit includes a first terminal, a second terminal, a power source applying a direct current voltage to the first and second terminals, and a current amount detection unit detecting a current value of a current flowing between the first and second terminals, wherein the first and second terminals are provided as sandwiching the belt, and wherein any one of the first and second terminals is in contact with the surface of the belt.

5. The image forming apparatus according to claim 4, wherein the control unit judges as the foreign object is attached to the surface of the belt, where the current value detected at the current amount detection unit is not in a predetermined range.

6. The image forming apparatus according to claim 3, wherein the detection unit is made of a plurality of photo sensors arranged in a line crossing the move direction of the belt.

7. The image forming apparatus according to claim 6, wherein the control unit judges as the foreign object is attached to the surface of the belt, where the detected value of the photo sensors in a prescribed number among the plural photo sensors is not in a predetermined range.

8. The image forming apparatus according to claim 1, further comprising:

a cutting unit disposed on an upstream side of the transfer unit in a conveyance route of the medium for cutting the medium;

an upstream side roller disposed on an upstream side of the cutting unit in the conveyance route of the medium for conveying the medium to the cutting unit; and a downstream side roller disposed on a downstream side of the cutting unit in the conveyance route of the medium for conveying the medium and delivering the medium to an exterior of an apparatus housing, wherein the cutting unit cuts the medium, wherein the upstream side roller stops the conveyance of the medium, and wherein the downstream side roller conveys the medium to deliver the medium to the exterior of the apparatus housing.

9. The image forming apparatus according to claim 8, wherein the belt contacts the medium at a portion that at least the developer image is transferred to the medium, and further comprising a moving unit moving the medium to a position not contacting to the belt at the portion that the developer image is transferred to the medium.

10. The image forming apparatus according to claim 9, wherein the moving unit comprises a support bar extending in a direction parallel to a longitudinal direction of the transfer unit, a support frame supporting an end of the support bar and an end of the transfer unit, and a frame drive unit moving the support frame to a first position at which the medium contacts the belt and to a second position at which the medium does not contact the belt, wherein the support bar moves the medium in a direction away from the belt at a time that the support frame moves from the first position to the second position.

11. The image forming apparatus according to claim 10, and further comprising an indication unit indicating information prompting a maintenance check based on the detected result at the detection unit.

12. The image forming apparatus according to claim 3, further comprising:

a cutting unit disposed on an upstream side of the transfer unit in a conveyance route of the medium for cutting the medium;

an upstream side roller disposed on an upstream side of the cutting unit in the conveyance route of the medium for conveying the medium to the cutting unit; and a downstream side roller disposed on a downstream side of the cutting unit in the conveyance route of the medium for conveying the medium and delivering the medium to an exterior of an apparatus housing, wherein the cutting unit cuts the medium, wherein the upstream side roller stops the conveyance of the medium, and wherein the downstream side roller conveys the medium to deliver the medium to the exterior of the apparatus housing.

13. The image forming apparatus according to claim 12, wherein the belt contacts the medium at a portion that at least the developer image is transferred to the medium, and further comprising a moving unit moving the medium to a position not contacting to the belt at the portion that the developer image is transferred to the medium.

14. The image forming apparatus according to claim 13, wherein the moving unit comprises a support bar extending in a direction parallel to a longitudinal direction of the transfer unit, a support frame supporting an end of the support bar and an end of the transfer unit, and a frame drive unit moving the support frame to a first position at which the medium contacts the belt and to a second position at which the medium does not contact the belt, wherein the support bar moves the medium in a direction away from the belt at a time that the support frame moves from the first position to the second position.

15. The image forming apparatus according to claim 14, and further comprising an indication unit indicating information prompting a maintenance check based on the detected result at the detection unit.

* * * * *